US009637335B2

(12) United States Patent
Ono

(10) Patent No.: US 9,637,335 B2
(45) Date of Patent: May 2, 2017

(54) IMAGE FORMING APPARATUS

(71) Applicant: KYOCERA Document Solutions Inc., Osaka-shi, Osaka (JP)

(72) Inventor: Tomohisa Ono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/994,960

(22) Filed: Jan. 13, 2016

(65) Prior Publication Data

US 2016/0209788 A1 Jul. 21, 2016

(30) Foreign Application Priority Data

Jan. 19, 2015 (JP) ..... 2015-007814

(51) Int. Cl.

| | |
|---|---|
| ***G03G 21/00*** | (2006.01) |
| ***B65H 5/06*** | (2006.01) |
| ***B65H 5/36*** | (2006.01) |
| ***G03G 15/23*** | (2006.01) |
| *G03G 15/00* | (2006.01) |

(52) U.S. Cl.

CPC ..... *B65H 5/06* (2013.01); *B65H 5/36* (2013.01); *G03G 15/234* (2013.01); *G03G 15/6529* (2013.01); *G03G 15/6552* (2013.01); *G03G 2215/00675* (2013.01); *G03G 2215/00679* (2013.01)

(58) Field of Classification Search

CPC ..... G03G 21/1638
USPC ..... 399/124
See application file for complete search history.

(56) References Cited

U.S. PATENT DOCUMENTS

| | | | | |
|---|---|---|---|---|
| 6,134,404 | A * | 10/2000 | Iwai | B65H 5/062 399/110 |
| 8,419,006 | B2 * | 4/2013 | Imura | B65H 85/00 271/3.14 |
| 2007/0092293 | A1 * | 4/2007 | Jang | G03G 21/1638 399/124 |
| 2008/0179823 | A1 * | 7/2008 | Yuzawa | B65H 29/58 271/225 |
| 2009/0166966 | A1 * | 7/2009 | Nishikata | B65H 5/062 271/272 |
| 2010/0098473 | A1 * | 4/2010 | Hosoi | B65H 5/38 399/400 |

(Continued)

FOREIGN PATENT DOCUMENTS

JP 2008-127185 A 6/2008

*Primary Examiner* — Anthony Nguyen
(74) *Attorney, Agent, or Firm* — Studebaker & Brackett PC

(57) ABSTRACT

An image forming apparatus includes a conveying path, a reverse path, a first guide member and a second guide member. The conveying path conveys a sheet to a discharge part. The reverse path conveys the sheet again to the image forming part. The first guide member is provided movably between a first closed position for forming the conveying path and a first opening position for opening the conveying path. The second guide member is provided movably between a second closed position for forming the reverse path and a second opening position for opening the reverse path. The first guide member contacts with the second guide member in a process of moving from the first closed position to the first opening position and moves the second guide member from the second closed position to the second opening position.

6 Claims, 11 Drawing Sheets

(56) References Cited

U.S. PATENT DOCUMENTS

| | | | | |
|---|---|---|---|---|
| 2011/0001284 | A1* | 1/2011 | Ohtsuki | B65H 5/26<br>271/162 |
| 2012/0155916 | A1* | 6/2012 | Ito | B41J 29/02<br>399/110 |
| 2013/0264769 | A1* | 10/2013 | Sugizaki | B65H 5/00<br>271/264 |

* cited by examiner

IMAGE FORMING APPARATUS

INCORPORATION BY REFERENCE

This application is based on and claims the benefit of priority from Japanese Patent application No. 2015-007814 filed on Jan. 19, 2015, the entire contents of which are incorporated herein by reference.

BACKGROUND

The present disclosure relates to a copying machine or a printer or the like including an image forming apparatus.

There is known an image forming apparatus capable of printing on both front and back surfaces of a sheet. The image forming apparatus is configured to reverse the front surface of the sheet on which an image has been formed by an image forming part and to convey the sheet again to the image forming part. The image forming apparatus includes a mechanism for removing a sheet jammed within a conveying path (unjamming).

For instance, there is a printer including a conveying path, a reverse path, and a switchback path. The conveying path conveys the sheet from one surface side to another surface side of an apparatus body via the image forming part. The reverse path conveys the sheet from a downstream side to an upstream side of the conveying path. The switchback path extends vertically from the downstream side of the conveying path to a sheet discharge part. A face-up tray composing the switchback path is turnably supported on a back surface of the apparatus body. A sub-tray composing the upstream side of the reverse path is turnably supported by the face-up tray. A JAM clearing unit for removing a sheet jammed in a vicinity of a fixing part is turnably provided on the downstream side of the conveying path. The JAM clearing unit composes the downstream side of the conveying path and the upstream side of the reverse path.

In a case when a sheet conveyance failure (a jam) occurs in the vicinity of the fixing part in the printer described above, the user executes an unjamming process by the following procedure. At first, the user opens the face-up tray and then turns the sub-tray to assure a work space at the upstream side of the reverse path. In succession, the user turns the JAM clearing unit to open the downstream side of the conveying path (the upstream side of the reverse path). Thereby, the user can remove the jammed sheet. It is noted that the user executes the unjamming process in accordance to instructions displayed on a liquid crystal display.

However, in executing the unjamming process in the printer described above, the user has to turn the face-up tray, the sub-tray, and the JAM clearing unit separately. To that end, the printer is required to instruct a plurality of steps for the unjamming process to the user. The user is also forced to correctly execute the plurality of steps. Thus, the printer described above has a problem that operability of the user is inferior due to the complexity of the procedure required in the unjamming process.

SUMMARY

In accordance with an embodiment of the present disclosure, an image forming apparatus includes a conveying path, a reverse path, a first guide member and a second guide member. The conveying path conveys a sheet from a supply part to a discharge part through an image forming part. The reverse path is branched from the conveying path on a downstream side in a sheet conveying direction of the image forming part and conveys the sheet again to the image forming part. The first guide member is provided movably between a first closed position for forming the conveying path and a first opening position for opening the conveying path. The second guide member is provided movably between a second closed position for forming the reverse path by facing the first guide member and a second opening position for opening the reverse path. The first guide member contacts with the second guide member in a process of moving from the first closed position to the first opening position and moves the second guide member from the second closed position to the second opening position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, a preferable embodiment of the present disclosure will be described with reference to the appended drawings. It is noted that the following description will be made by setting a near side of each drawing as a front side and based on directions indicated in each drawing. Still further, such terms as 'upstream' and 'downstream' in the following description represent 'upstream', 'downstream' or the like in a conveying direction of a sheet S.

Figure 1:
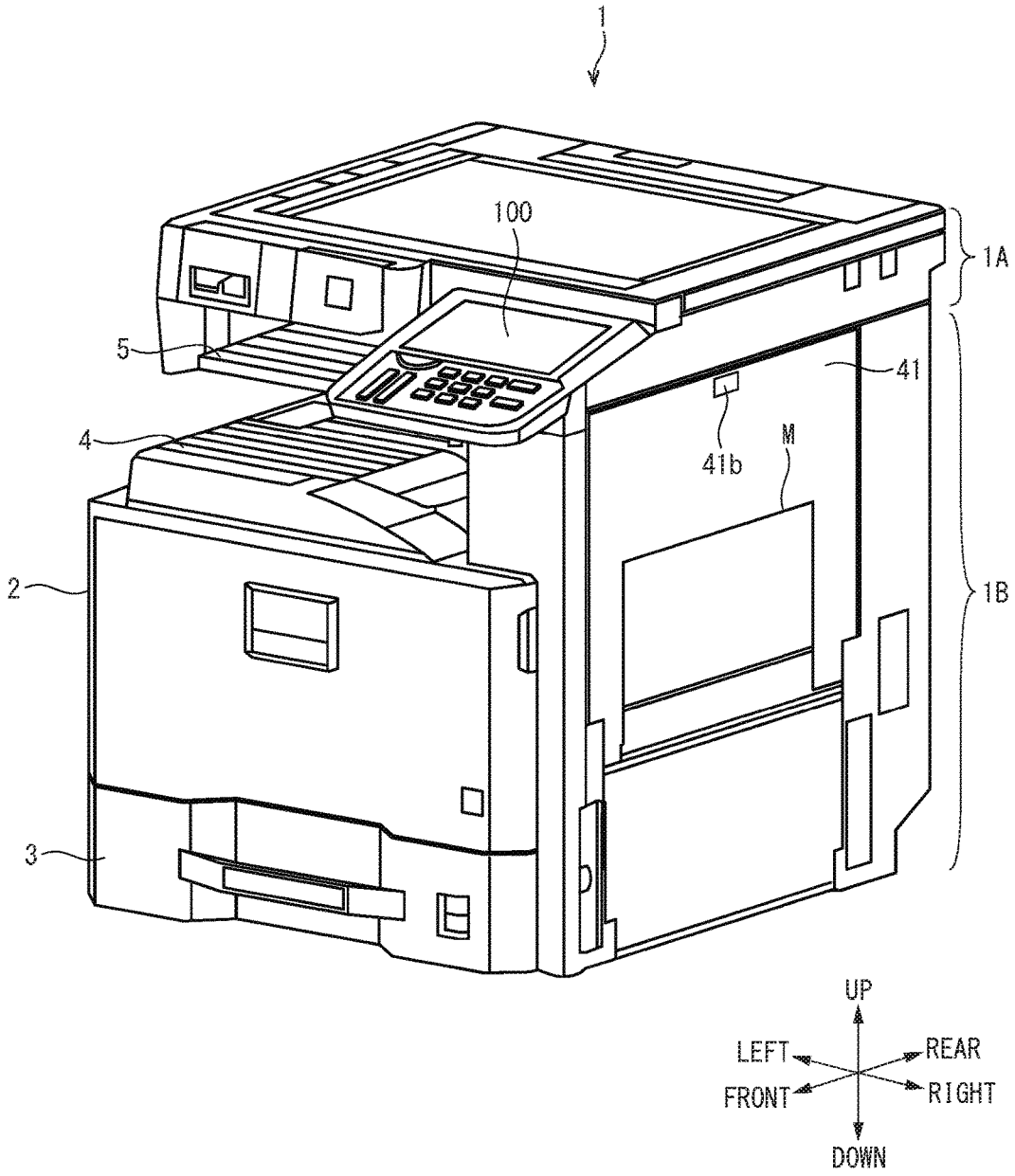
FIG. 1 is a perspective view showing a multi-function printer of one embodiment of the present disclosure.
Figure 2:
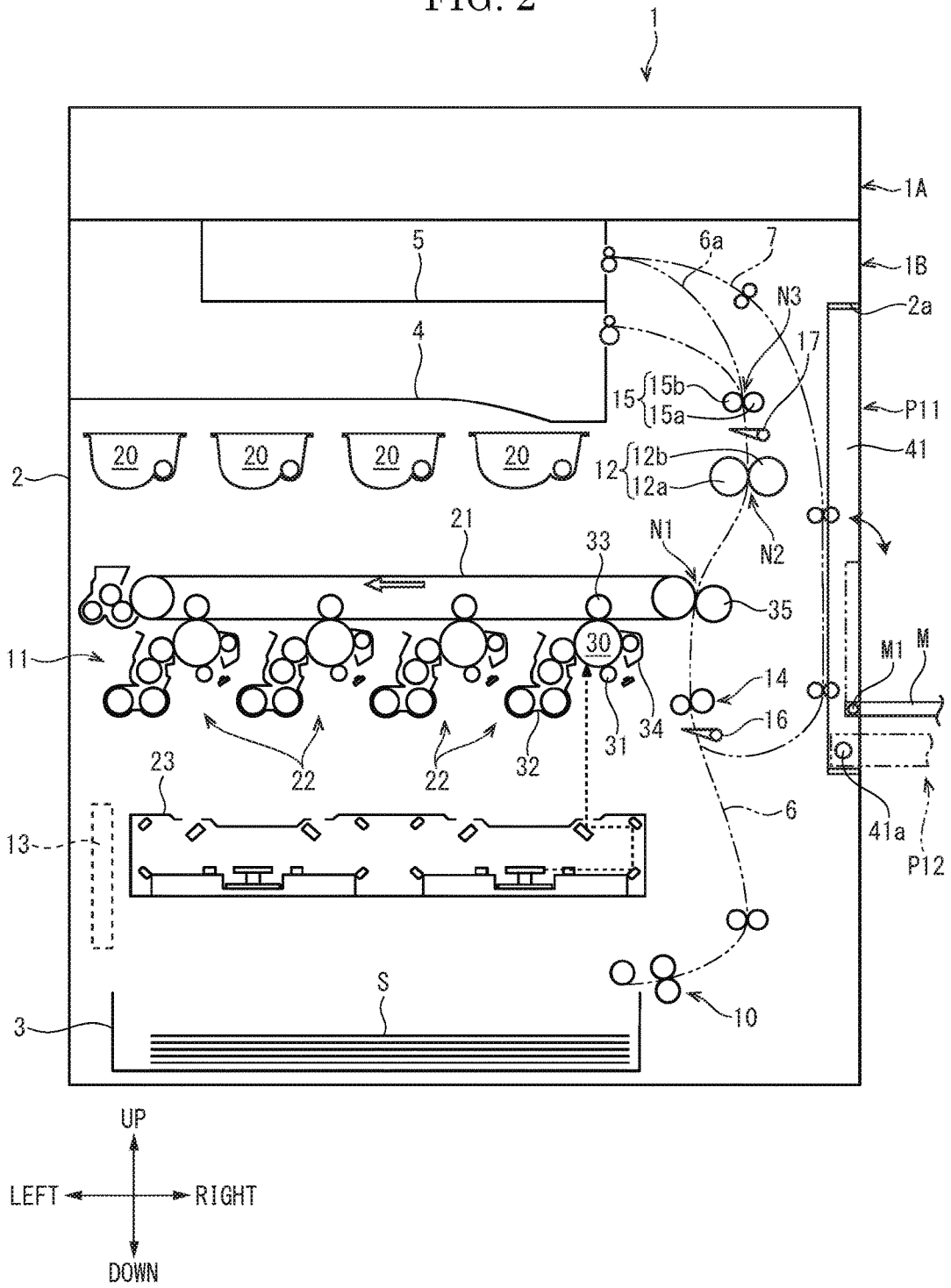
FIG. 2 is a sectional view schematically showing an inner structure of the multi-function printer according to one embodiment of the present disclosure.

With reference to FIG. 1 and FIG. 2, an entire construction of a multi-function printer 1 as an image forming apparatus will be described. FIG. 1 is a perspective view showing the multi-function printer 1. FIG. 2 is a sectional view schematically showing an inner structure of the multi-function printer 1.

The multi-function printer 1 includes a scanner unit 1A and a printing apparatus 1B. The scanner unit 1A optically reads image information of a document. The printing apparatus 1B forms an image electro-photographically on the sheet S.

The scanner unit 1A is disposed above the printing apparatus 1B. An automatic document feeder not shown conveying a document to a reading position is disposed on an upper surface of the scanner unit 1A. It is noted that because the scanner unit 1A has an ordinary known structure, a detailed description thereof will be omitted here.

The scanner unit 1A is provided with an operating part 100 including a liquid crystal panel, push buttons and others at a front part thereof. The user executes various functions and changes settings of the multi-function printer 1 by operating the operating part 100.

The printing apparatus 1B includes an apparatus body 2, a sheet feed cassette 3 and two sheet discharge trays 4 and 5. The apparatus body 2 is formed substantially into a shape of a box. The sheet feed cassette 3, i.e., a supply part, is provided drawably in a lower part of the apparatus body 2. Two sheet discharge trays 4 and 5, i.e., discharge parts, are layered up and down between the scanner unit 1A and the apparatus body 2.

As shown in FIG. 2, a conveying path 6 and a reverse path 7 for conveying the sheet S are formed within the apparatus body 2. The conveying path 6 extends from the sheet feed cassette 3 to the respective sheet discharge trays 4 and 5. The reverse path 7 is formed so as to connect a downstream side with an upstream side of the conveying path 6. It is noted that the respective conveying paths 6 and 7 will be detailed later.

Still further, the printing apparatus 1B includes a sheet feed mechanism 10, an image forming part 11, a fixing device 12 and a control device 13 within the apparatus body 2. The sheet feed mechanism 10 is provided on the upstream side of the conveying path 6. The image forming part 11 is provided at an intermediate part of the conveying path 6. The fixing device 12 is provided on the downstream side of the conveying path 6. The control device 13 is provided to integrally control the respective components of the multi-function printer 1.

The sheet feed mechanism 10 delivers the sheet S stored in the sheet feed cassette 3 to the conveying path 6. The conveying path 6 extends vertically to convey the sheet S toward the respective sheet discharge trays 4 and 5 through the image forming part 11. The conveying path 6 is provided with a registration roller pair 14, a conveying roller pair 15, and others. The registration roller pair 14 is disposed on the downstream side of the sheet feed mechanism 10. The conveying roller pair 15 is disposed on the downstream side of the fixing device 12. It is noted that the conveying path 6 is provided also with a plurality of detecting devices 16 and 17 detecting the sheet S passing through the registration roller pair 14, the conveying roller pair 15, and others.

The downstream side of the conveying path 6 (the downstream side of the conveying roller pair 15) is branched up and down. The conveying path 6 branched downward extends toward the lower sheet discharge tray 4. On the other hand, the conveying path 6 branched upward (referred to also as an 'upper conveying path 6*a*' hereinafter) extends toward the upper sheet discharge tray 5. The upper conveying path 6*a* is also connected with the reverse path 7 for printing on both surfaces of the sheet S. The reverse path 7 is branched from the upper conveying path 6*a* and extends downward. A downstream end of the reverse path 7 joins with the conveying path 6 on the upstream side of the registration roller pair 14.

The image forming part 11 includes four tonner containers 20, an intermediate transfer belt 21, four drum units 22 and an optical scanning device 23. The four toner containers 20 are provided in parallel to each other in a right-left direction on a lower side of the sheet discharge tray 4. The intermediate transfer belt 21 is arranged on a lower side of each of the toner containers 20. The four drum units 22 are provided in parallel to each other in the right-left direction on a lower side of the intermediate transfer belt 21. The optical scanning device 23 is arranged on a lower side of each of the drum units 22.

The four tonner containers 20 house toners (developing agents) of four colors (yellow, magenta, cyan, black). Each of the drum units 22 includes a photosensitive drum 30, a charging device 31, a development device 32, a primary transferring roller 33, and a cleaning device 34. Incidentally, the four drum units 22 each have a similar configuration; and therefore, one of the drum units 22 will be described hereinafter.

The photosensitive drum 30 is supported so as to rotate around a coaxial center. The photosensitive drum comes into contact with a lower surface of the intermediate transfer belt 21. The charging device 31, the development device 32, the primary transferring roller 33 and the cleaning device 34 are disposed in sequential order of the transferring steps around the photosensitive drum 30. The primary transferring roller 33 is disposed to be opposed to the photosensitive drum 30 from the top side while the intermediate transfer belt 21 is sandwiched therebetween. On the right side of the intermediate transfer belt 21, a secondary transfer roller 36 is disposed, and a secondary transfer nip part N1 is formed.

The fixing device 12 includes a heating roller 12*a* and a pressure roller 12*b*. The pressure roller 12*b* is in pressure contact with the heating roller 12*a* and forms a fixing nip N2 with the heating roller 12*a*. The pressure roller 12*b* is rotationally driven by a driving source not shown, and the heating roller 12*a* is rotationally driven.

Here, an operation of the printing apparatus 1B will be briefly described. The control device 13 executes an image forming process as follows based on image data inputted from the scanner unit 1A or the like.

Each charging device 31 electrifies a surface of the photosensitive drum 30. The optical scanning device 23 emits a scan light (see an arrow of a broken line in FIG. 1) corresponding to the image data to each photosensitive drum 30. Thereby, an electrostatic latent image is formed on the surface of the photosensitive drum 30. Each development device 32 develops the electrostatic latent image as a toner image by using toner. Four toner images borne on the respective photosensitive drums 30 are sequentially primarily transferred onto a traveling intermediate transfer belt 21 by primary transferring rollers 33 to which a primary transfer bias is applied. Thereby, a full-color toner image is formed on the surface of the intermediate transfer belt 21.

Meanwhile, the sheet S supplied from the sheet feed cassette 3 or the like is conveyed through the conveying path 6 and passes through a secondary transfer nip part N1. The full-color toner image is secondarily transferred onto the sheet S by a secondary transfer roller to which a secondary transfer bias is applied. The fixing device 12 fixes the transferred toner image on the sheet S. The sheet S which has undergone the fixing process is discharged to the sheet discharge tray 4 or the like. Each cleaning device 34 removes toner left on the surface of the photosensitive drum 30 after the transfer.

In the case of printing on the both surfaces of the sheet S, the sheet S which has passed through the fixing nip N2 of the fixing device 12 enters the upper conveying path 6*a* once and then is switched back to be sent to the reverse path 7. The sheet S enters from the reverse path 7 to the conveying path 6 again and is conveyed again toward the image forming part 11 (the secondary transfer nip part N1). Thereby, an image is formed on the back surface of the sheet S.

By the way, the multi-function printer 1 (the printing apparatus 1B) of the present embodiment is configured to detect a conveyance failure (a jam) of the sheet S by using the respective detecting devices 16 and 17 disposed along the conveying path 6. While a detailed description of the detecting devices 16 and 17 will be omitted here, the respective detecting devices 16 and 17 include a photo-interrupter detecting a swingable actuator. It is noted that the respective detecting devices 16 and 17 are electrically connected with the control device 13.

If a jam occurs around the fixing device 12 for example, the detecting device 17 transmits a light receiving signal indicating the occurrence of a jam to the control device 13. Recognizing the occurrence of the jam, the control device 13 stops the image forming operation. Then, the control device 13 displays a message or the like indicating the occurrence of the jam around the fixing device 12 on the operation part 100 (liquid crystal screen). Then, the user executes an unjamming process (jam clearing process) in accordance to the message displayed on the operation part 100.

Figure 3:
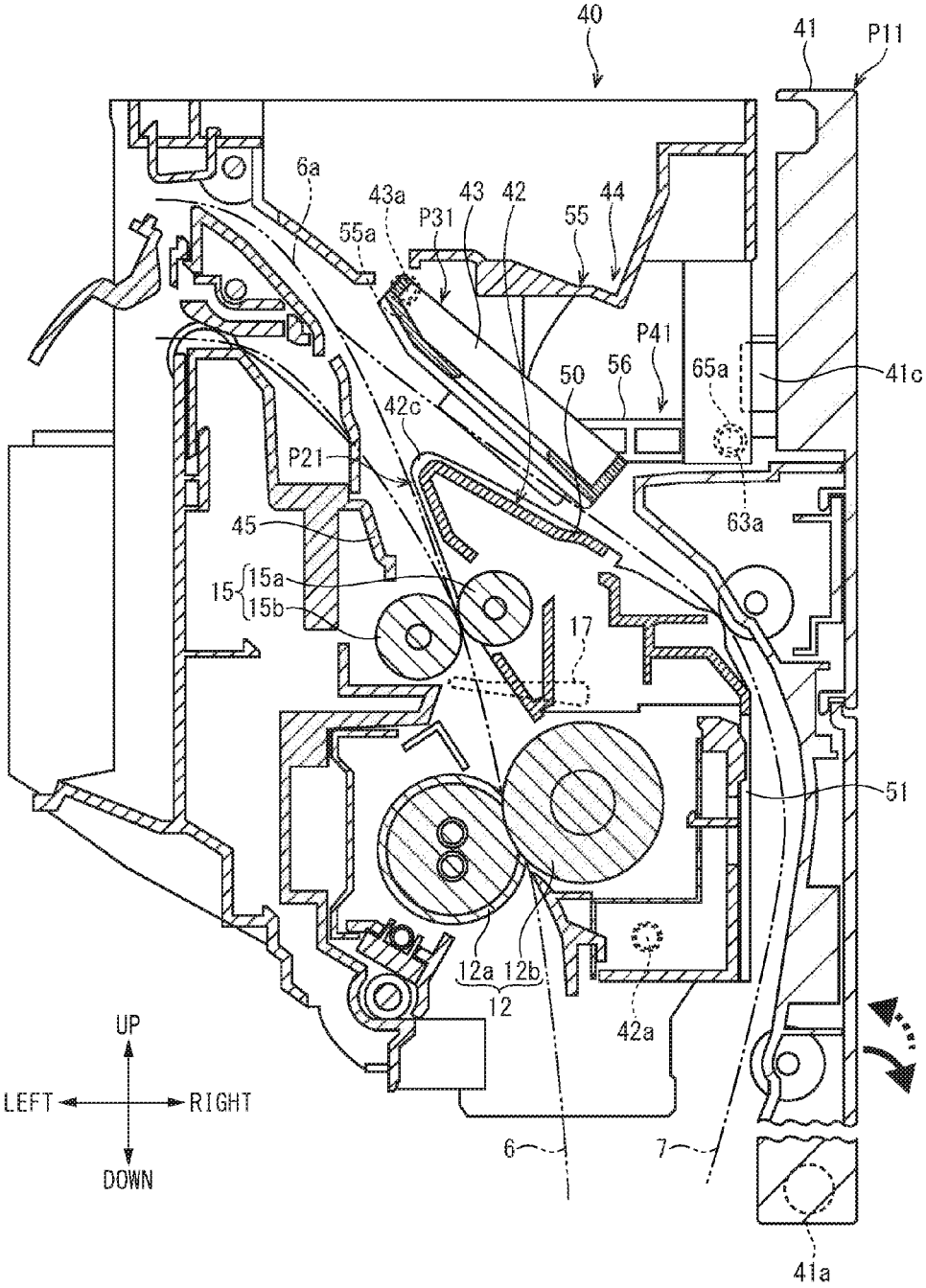
FIG. 3 is a section view schematically illustrating a jam processing structure of the multi-function printer according to one embodiment of the present disclosure.
Figure 4:
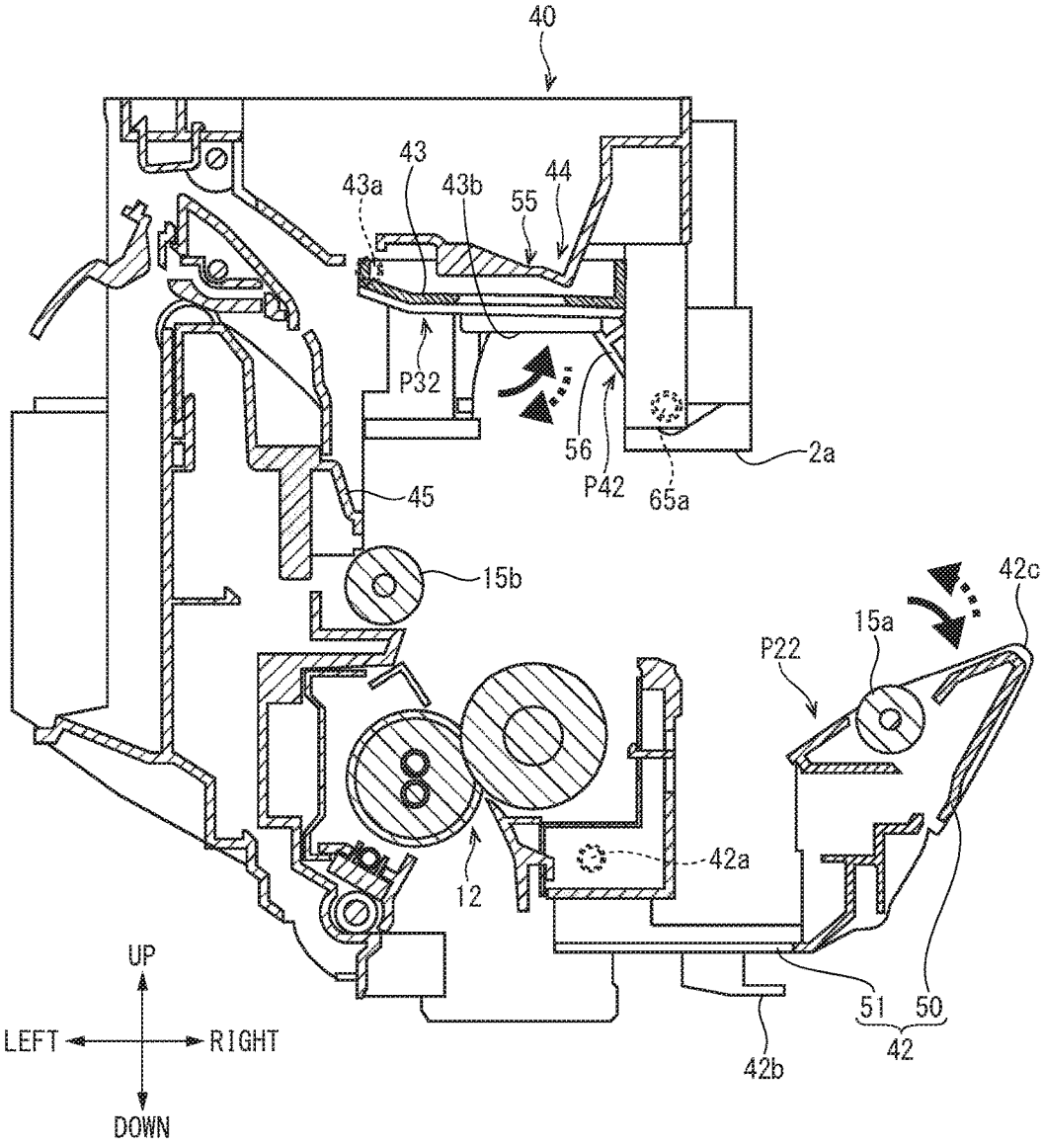
FIG. 4 is a section view schematically illustrating the jam processing structure of the multi-function printer of one embodiment of the present disclosure in a state in which first and second guide members are opened.
Figure 5:
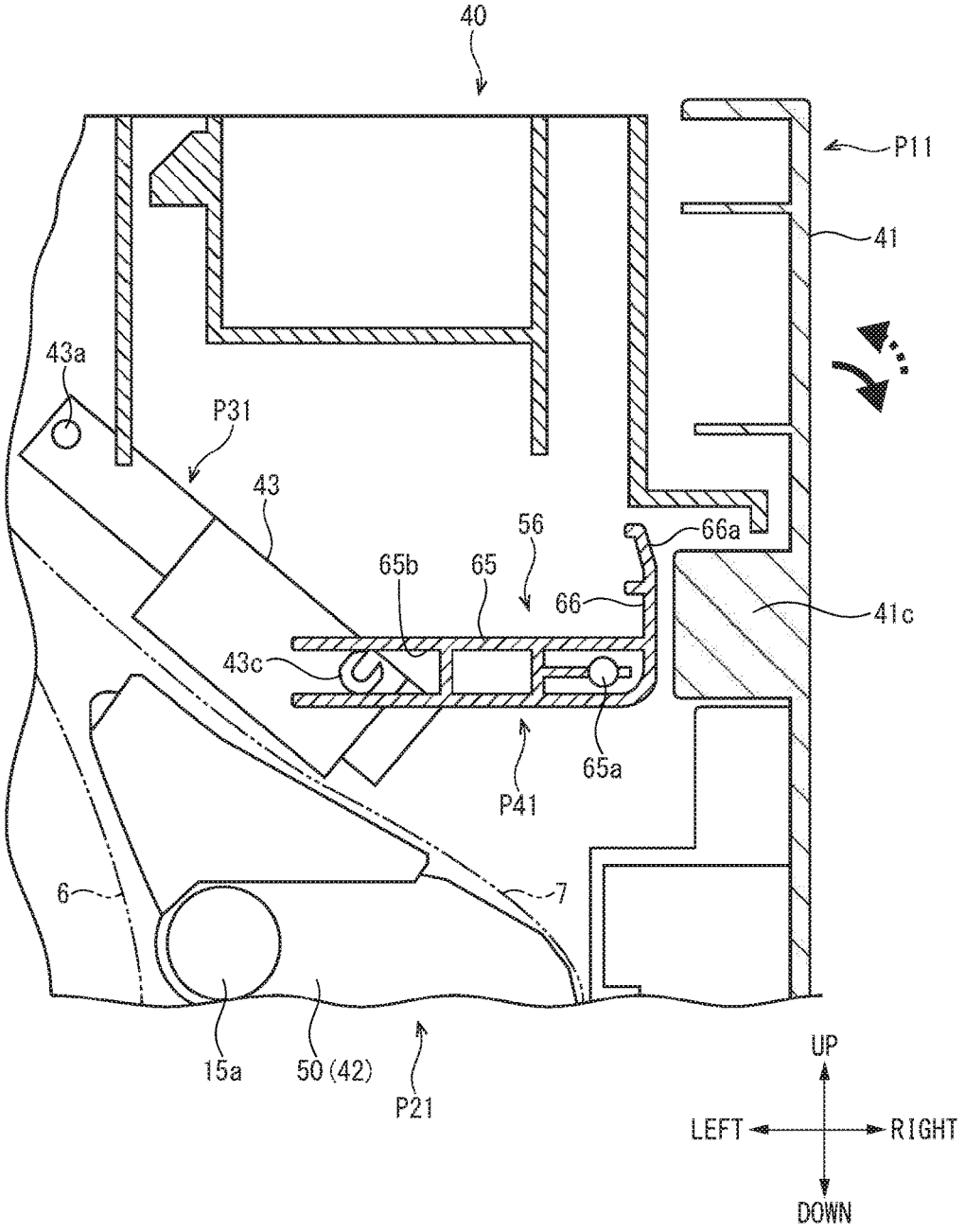
FIG. 5 is a section view schematically illustrating a part of the jam processing structure of the multi-function printer of one embodiment of the present disclosure.
Figure 6:
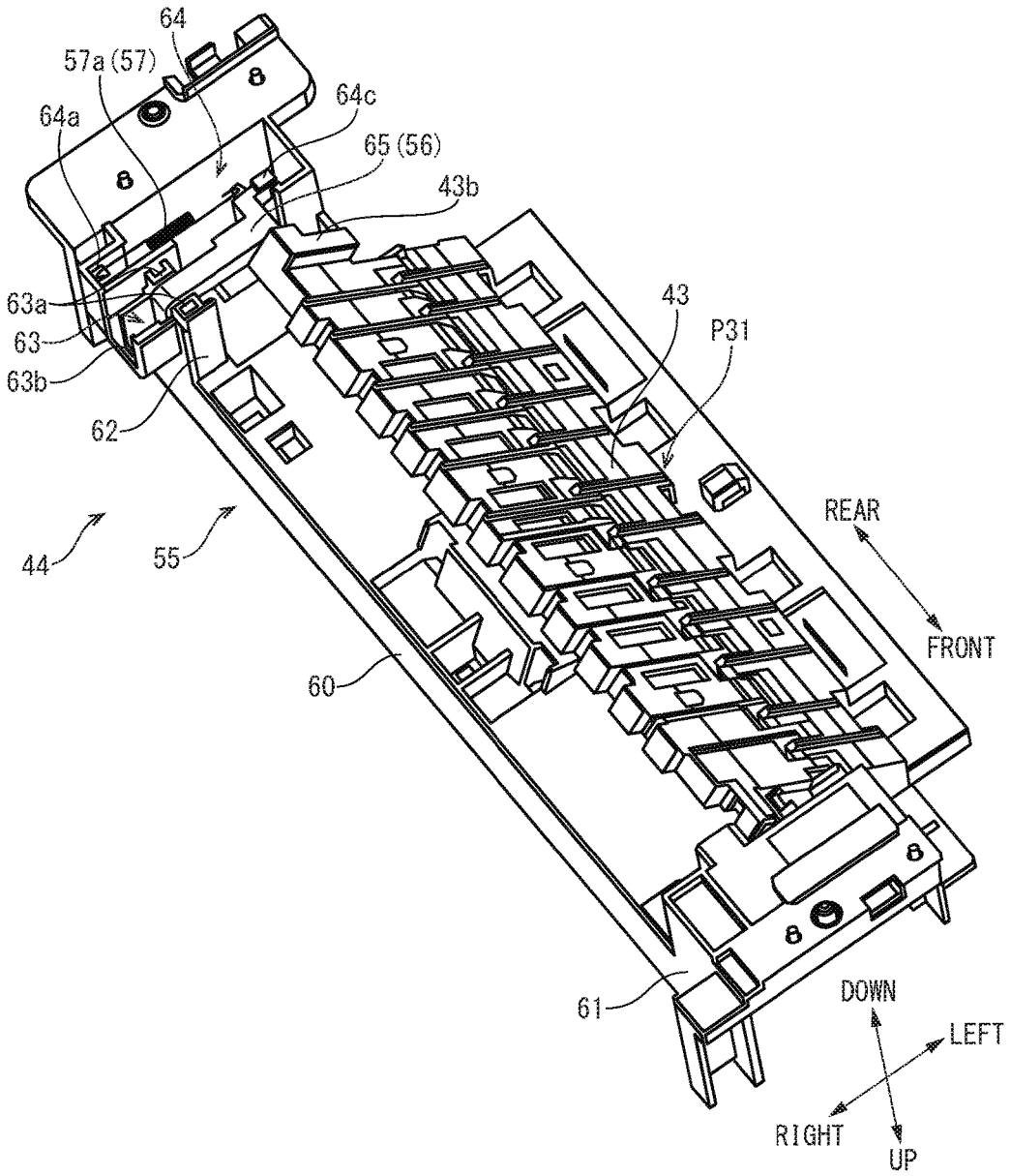
FIG. 6 is a perspective view schematically illustrating a move supporting mechanism and others of the multi-function printer according to one embodiment of the present disclosure.
Figure 7:
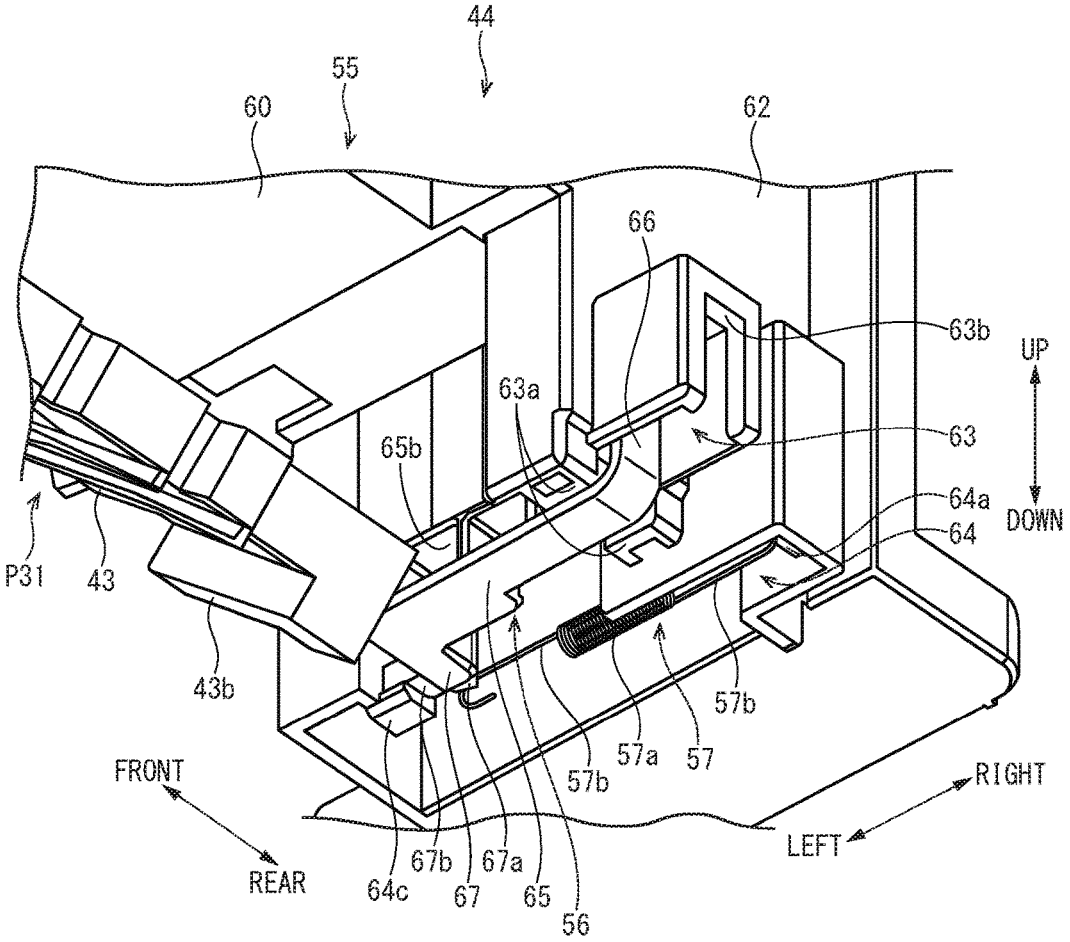
FIG. 7 is a perspective view schematically illustrating a part of the move supporting mechanism of the multi-function printer according to one embodiment of the present disclosure.
Figure 8:
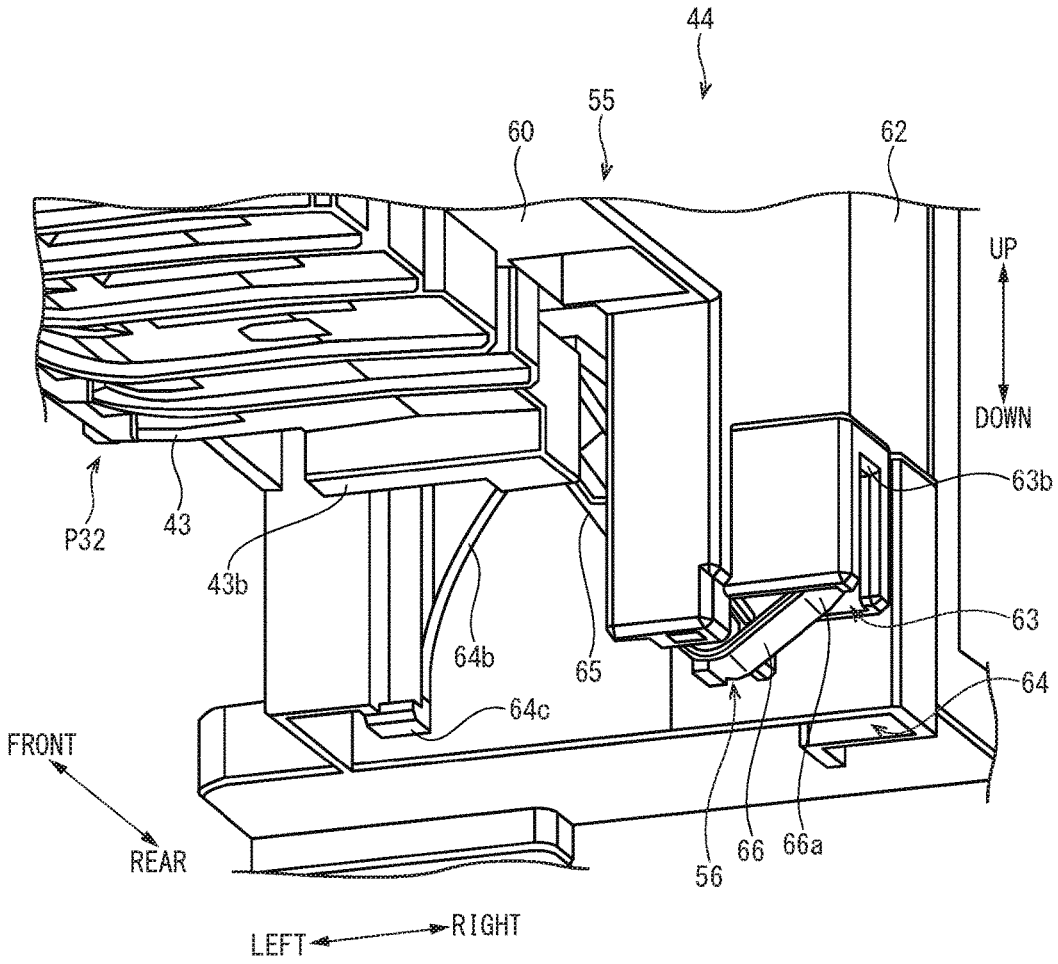
FIG. 8 is a perspective view schematically illustrating the move supporting mechanism of the multi-function printer according to one embodiment of the present disclosure in a state in which the second guide member is opened.
Figure 9:
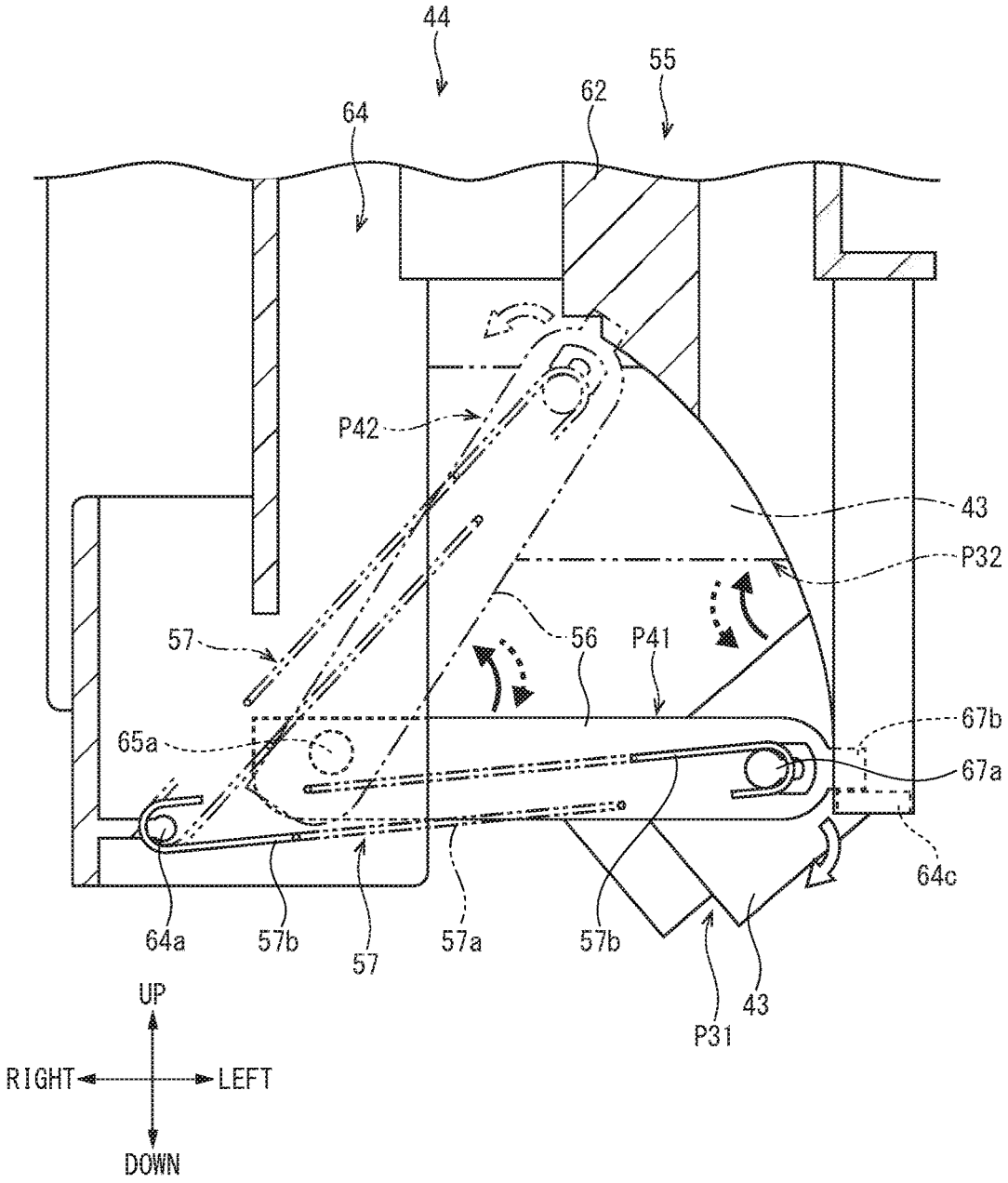
FIG. 9 is a section view schematically illustrating a lever and an elastic member of the move supporting mechanism of the multi-function printer according to one embodiment of the present disclosure.

The multi-function printer 1 (the printing apparatus 1B) of the present embodiment includes a jam processing structure 40 for removing the sheet S jammed around the fixing device 12. The jam processing structure 40 will be described with reference to FIGS. 1 through 9. FIG. 3 is a section view schematically illustrating the jam processing structure 40. FIG. 4 is a section view schematically illustrating the jam processing structure 40 in a state in which first and second guide members 42 and are opened. FIG. 5 is a section view schematically illustrating a part of the jam processing structure 40. FIG. 6 is a perspective view schematically illustrating a move supporting mechanism 44 and others. FIG. 7 is a perspective view schematically illustrating a part of the move supporting mechanism 44. FIG. 8 is a perspective view schematically illustrating the move supporting mechanism 44 in a state in which the second guide member 43 is opened. FIG. 9 is a section view schematically illustrating a lever and an elastic member 57 of the move supporting mechanism 44.

As shown in FIG. 3, the jam processing structure 40 includes a cover 41, a first guide member 42, a second guide members 43 and a move support mechanism 44. The cover 41 is provided openably/closably on a right side surface of the apparatus body 2. The first guide member 42 and the second guide member 43 are supported within the apparatus body 2. The move support mechanism 44 is configured to guide a movement of the second guide member 43.

As shown in FIG. 1, the cover 41 is formed substantially into a rectangular plate by a synthetic resin material for example. As shown in FIG. 2, the cover 41 is provided with a manual tray M turnably centering on a rotating shaft M1. A pair of cover rotating shafts 41*a* is projectively provided at a lower part of both front and rear sides of the cover 41. The pair of front and rear cover rotating shafts 41*a* is pivotally supported within an opening 2*a* formed on the right side surface of the apparatus body 2. Thereby, the cover 41 turns centering on the respective cover rotating shafts 41*a*. More specifically, the cover 41 is provided turnably between a closing position P11 for closing the opening 2*a* and an opening position P12 for opening the opening 2*a*. It is possible to expose a part of the reverse path 7 and a part of the conveying path 6 on the upstream side of the fixing device 12 by displacing the cover 41 to the opening position P12. This arrangement makes it possible to conduct such works as maintenance within the apparatus body 2.

As shown in FIGS. 2 and 3, an outer surface of the cover 41 (the closed manual tray M) displaced to the closing position P11 composes a part of a sheath surface of the apparatus body 2. An inner surface of the cover 41 displaced to the closing position P11 forms one side surface of the reverse path 7. Provided at an upper outer surface of the cover 41 is a unlock lever 41*b* unlocking the cover 41 displaced to the opening position P12 (see FIG. 1). A pressing piece 41*c* is projectively provided on an upper inner surface of the cover 41 toward the inside of the apparatus body 2 (see FIGS. 3 and 5). The pressing piece 41*c* is formed into a rectangular plate in a front view.

As shown in FIGS. 3 and 4, the first guide member 42 includes a guide portion 50 and a pair of front and rear arms 51. The first guide member 42 is formed integrally by a synthetic resin material for example.

The guide portion 50 is formed substantially into a triangular column lengthy in a front-rear direction. The guide portion 50 is disposed downstream of (above) the pressure roller 12*b* of the fixing device 12. The guide portion 50 rotatably supports the driven roller 15*a* (one roller) of the conveying roller pair 15.

The pair of front and rear arms 51 extends respectively from the guide portion 50 downward so as to surround the pressure roller 12*b*. A first rotating shaft 42*a* pivotally supported by the fixing device 12 is formed at a lower end part of each arm 51. Thereby, the first guide member 42 turns centering on the first rotating shaft 42*a*. More specifically, the first guide member 42 is provided movably (turnably) between a first closed position P21 (see FIG. 3) for forming a part of the conveying path 6 and a first opening position P22 (see FIG. 4) for opening the conveying path 6. It is noted that a handle part 42*b* for turnably operating the first guide member 42 is provided on an outer surface of one arm 51.

As shown in FIG. 3, the guide portion 50 is disposed so as to face to a right side of a fixed guide member 45 fixed to the apparatus body 2 in a state in which the first guide member 42 is displaced to the first closed position P21. Then, the first guide member 42 (the guide portion 50) is configured to be the conveying path 6 with the fixed guide member 45 on the downstream side of the fixing device 12. It is noted that the fixed guide member 45 rotatably supports the driving roller 15*b* (the other roller) of the conveying roller pair 15 driven by the driving source not shown.

A pressing part 42*c* formed substantially into a shape of a wedge in a front view is formed on an upper end part of the guide portion 50. The pressing part 42*c* composes a part where the conveying path 6 joins with the reverse path 7 in the state in which the first guide member 42 is displaced to the first closed position P21.

As shown in FIG. 6, the second guide member 43 is formed into a rectangular thick plate lengthy in the front-rear direction by a synthetic resin material for example. As shown in FIGS. 3 through 5, a pair of second rotating shafts 43*a* is projectively provided on both front and rear surfaces of a left end part of the second guide member 43. The pair of front and rear second rotating shafts 43*a* are pivotally supported by a frame 55 of a move support mechanism 44 described later. Thereby, the second guide member 43 turns centering on the rotating shafts 43*a*. More specifically, the second guide member 43 is provided movably (swingably) between a second closed position P31 (see FIG. 3) for forming a part of the reverse path 7 and a second opening position P32 (see FIG. 4) for opening the reverse path 7.

The second guide member 43 displaced to the second closed position P31 is held in an inclined position, i.e., in an upslope, from the right side to the left side (see FIG. 3). The second guide member 43 displaced to the second closed position P31 is disposed so as to face an upper side of the guide portion 50 of the first guide member 42. Then, the second guide member 43 composes the reverse path 7 with the guide portion 50. That is, a lower surface (one surface) of the guide portion 50 of the first guide member 42 described above composes a downstream part of the conveying path 6 and an upper surface (other surface) of the guide portion 50 composes an upstream part of the reverse path 7. The second guide member 43 displaced to the second opening position P32 is held substantially in a horizontal position (see FIG. 4). Thereby, the part where the conveying path 6 joins with the reverse path 7 is opened.

As shown in FIG. 6, an abutment surface 43*b* is formed on a rear lower surface of the second guide member 43. While a detail will be described later, the pressing part 42*c* of the first guide member 42 moving from the first closed position P21 to the first opening position P22 abuts against the abutment surface 43*b*. A slide boss 43*c* formed substantially into a columnar shape is projectively provided on a right side of a rear side surface of the second guide member 43 (see FIG. 5).

As shown in FIG. 6, the move support mechanism 44 includes a frame 55, a lever 56 and an elastic member 57. The frame 55 turnably supports the second guide member 43. The lever 56 links the frame 55 with the second guide member 43. The elastic member 57 is mounted between the lever 56 and the frame 55.

The frame 55 includes a front wall part 61 and a rear wall part 62. The frame 55 is formed integrally by a synthetic resin material for example. The frame 55 is attached to the apparatus body 2 through an intermediary of front and rear wall parts 61 and 62. A frame body part 60 is formed substantially into a rectangular parallelepiped shape lengthy in the front-rear direction. The front wall part 61 is provided so as to be suspended from a front end part of the frame body part 60. The rear wall part 62 is provided so as to suspend from a rear end part of the frame body part 60. The second guide member 43 is disposed between the front wall part 61 and the rear wall part 62. Guide bearing parts 55*a* for pivotally supporting the second rotating shaft 43*a* of the second guide member 43 are formed respectively on a left end part of the front wall part 61 and a left end part of the rear wall part 62 (see FIG. 3).

As shown in FIGS. 6 through 8, the rear wall part 62 includes a lever storage part 63 and a spring storing part 64. The lever storage part 63 is formed adjacent a rear side of the frame body part 60. The spring storing part 64 is formed adjacent a rear side of the lever storage part 63.

The lever storage part 63 is formed substantially into a shape of a rectangular box whose lower surface is opened on a right side of the frame body part 60. A pair of front and rear lever bearing parts 63*a* is formed at a lower part of the lever storage part 63. A slit part 63*b* lengthy in the vertical direction is cut on a right side surface of the lever storage part 63.

The spring storing part 64 is formed substantially into a shape of a rectangular box whose lower surface is opened. A spring engaging hole 64*a* is formed on a right lower part of the spring storing part 64. A curved guide part 64*b* formed into a circular arc in a side view is formed on a left side of the lever storage part 63 (see FIG. 8). The curved guide part 64*b* is curved so as to be an upslope from the left side to the right side. A substantially plate-like lever locking part 64*c* is formed at a lower left end part of the curved guide part 64*b*.

It is noted that a tensile coil spring not shown is mounted between the front wall part 61 and a front side surface of the second guide member 43. This tensile coil spring biases the second guide member 43 toward the second closed position P31.

As shown in FIGS. 5, 7 and 8, the lever 56 includes a lever body part 65, an abutment part 66 and an engagement part 67. The lever 56 is formed integrally by a synthetic resin material for example.

The lever body part 65 is formed substantially into a rectangular parallelepiped shape lengthy in the left-right direction. The lever body part 65 includes a stepped part projecting rearward at an intermediate part in the left-right direction and is formed such that a width of the left side is wider than that of the right side (see FIG. 7). Lever rotating shafts 65*a* are projectively provided on both front and rear side surfaces of a right end part of the lever body part 65 (see FIG. 5). Each lever rotating shaft 65*a* is pivotally supported by a lever bearing part 63*a* of the lever storage part 63. It is noted that the spring engaging hole 64*a* of the spring storing part 64 described above is formed at a position shifted in a lower right direction from each lever rotating shaft 65*a* (each lever bearing portion 63*a*) in a front view (see FIG. 9).

A guide groove 65*b* is provided concavely on a front side surface on the left side of the lever body part 65 (see FIG. 5). The guide groove 65*b* extends in the left-right direction along the lever body part 65. A slide boss 43*c* of the second guide member 43 is slidably supported by the guide groove 65*b* (see FIG. 5).

As shown in FIG. 5, the abutment part 66 extends upward from a right end part of the lever body part 65. That is, the lever 56 is formed substantially into a shape of a letter L in a front view. The abutment part 66 is formed substantially into a plate and is bent slightly to the left side at an intermediate part in the vertical direction. Thereby, the upper side of the abutment part 66 composes an inclined surface 66*a*, i.e., an upslope, from the right side to the left side.

As shown in FIG. 7, the engagement part 67 is projectively provided rearward from the left end part of the lever body part 65. A spring engaging part 67*a* is formed on a rear side surface of the engagement part 67. A lock convex part 67*b* projecting to the left side is formed on a left side surface of the engagement part 67.

As shown in FIGS. 7 and 9, the elastic member 57 is a so-called tensile coil spring, and includes a pair of left and right hook parts 57*b* at both ends of an elastically deformable coil part 57*a*. It is noted that FIG. 9 illustrates the lever 56 and the elastic member 57 seen from a back surface of the move support mechanism 44. The hook part 57*b* on the right side is hooked to the spring engaging hole 64*a* of the rear wall part 62 (the spring storing part 64). The hook part 57*b* on the left side is hooked to a spring engaging part 67*a* of the lever 56.

As shown in FIGS. 5 and 9, the lever 56 is supported by the lever storage part 63 of the frame 55 so as to turn centering on each lever rotating shaft 65*a*. More specifically, by being biased by the elastic member 57, the lever 56 is supported by the frame 55 so as to turn between a closure holding position P41 holding the second guide member 43 at the second closed position P31 and an open holding position P42 holding the second guide member 43 at the second opening position P32. Still further, in response to the turn of the lever 56, the elastic member 57 turns centering on a part where the right hook part 57*b* engages with the spring engaging hole 64*a*. The elastic member 57 is provided to be slightly upslope from the right side to the left side in the state in which the lever 56 is displaced to the closure holding position P41.

Because a center of the turn of the elastic member 57 is shifted to the lower right direction from a center of the turn of the lever 56 in a front view, the lever 56 displaced to the closure holding position P41 receives a moment (see a blanked solid line arrow in FIG. 9) that turns the lever 56 downward (clockwise in FIG. 9) by a bias force (tension) of the elastic member 57. Thereby, the lever 56 is maintained substantially in a horizontal position (the state displaced to the closure holding position P41). The lever 56 displaced to the closure holding position P41 hooks a lock convex part 67*b* to the lever locking part 64*c* formed in the curved guide part 64*b* of the rear wall part 62 (the spring storing part 64). Thereby, the lever 56 is held without falling down out of the spring storing part 64. Meanwhile, the lever 56 displaced to the open holding position P42 receives a moment (see a blanked two-dot chain line arrow in FIG. 9) that turns the lever 56 upward (counterclockwise in FIG. 9) by the bias force (tension) of the elastic member 57. Thereby, the lever 56 is maintained in a position of the upslope from the right side to the left side (the state displaced to the open holding position P42).

Figure 10:
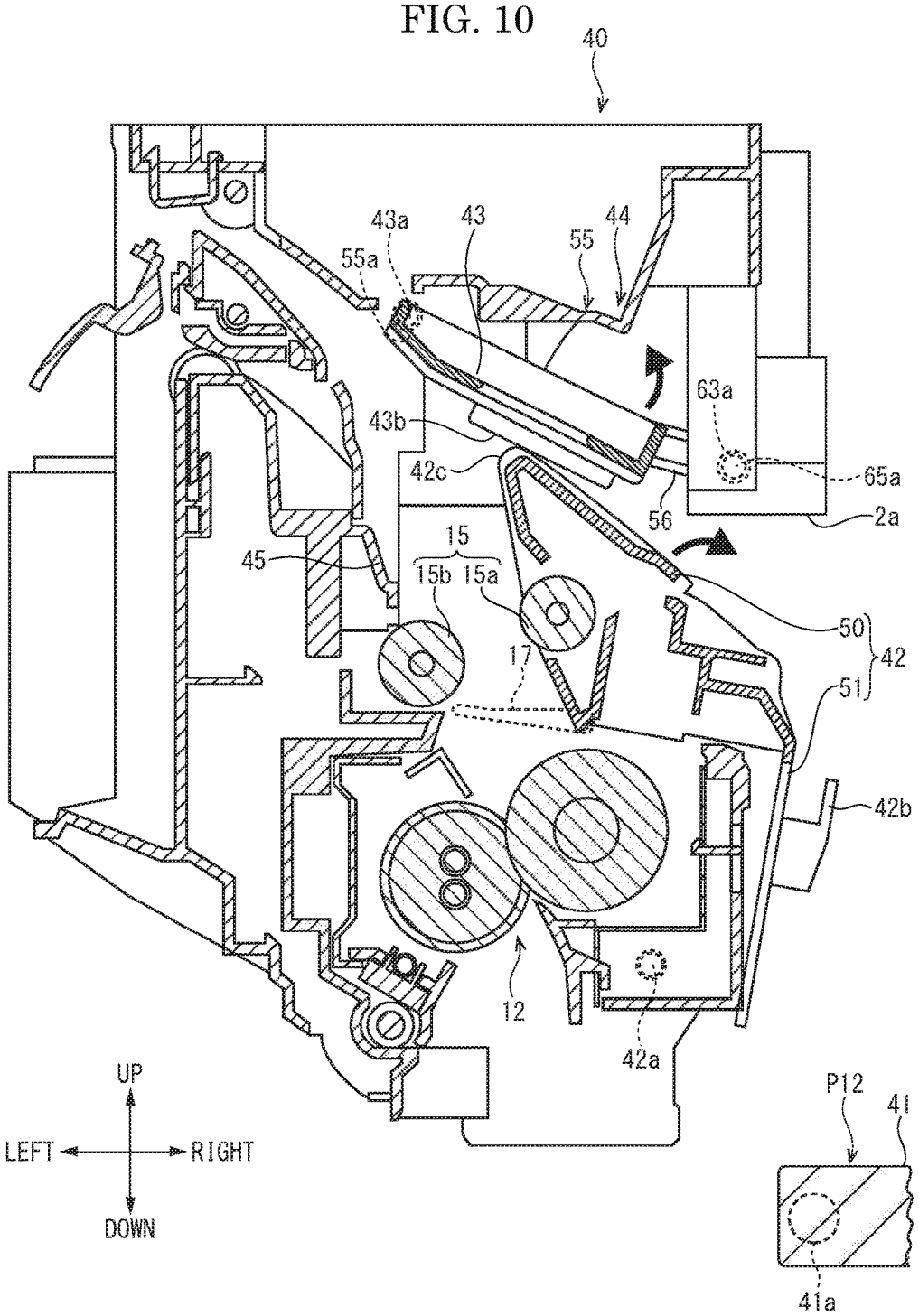
FIG. 10 is a section view schematically illustrating a process of opening the first and second guide members in the jam processing structure of the multi-function printer according to one embodiment of the present disclosure.
Figure 11:
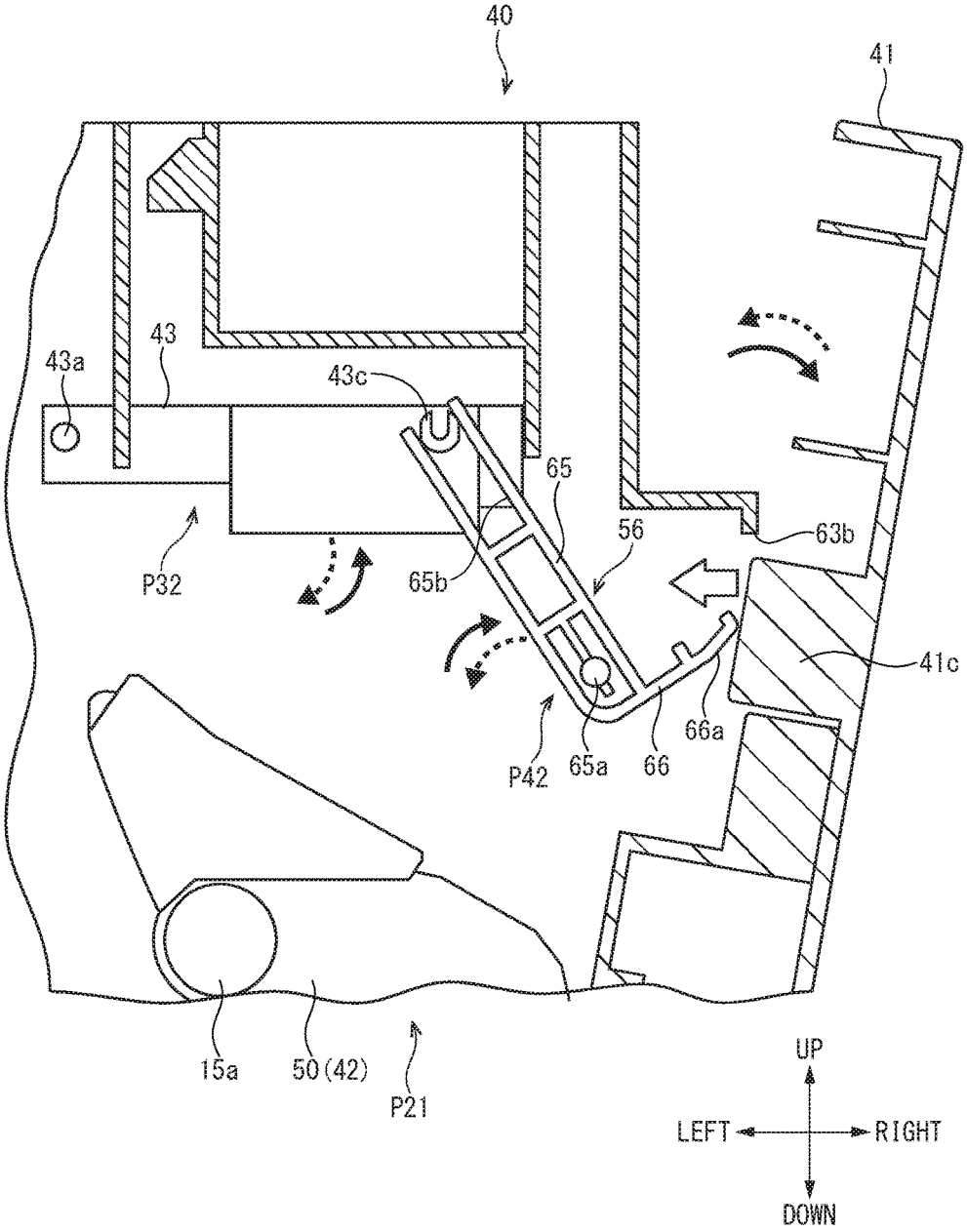
FIG. 11 is a section view schematically illustrating a process of closing a cover in a part of the jam processing structure of the multi-function printer according to one embodiment of the present disclosure.

Next, operations of the jam processing structure 40 will be described with reference to FIGS. 3 through 5, 10 and 11. Here, a case when the detecting device 17 detects a jam around the fixing device 12 will be described. FIG. 10 is a section view schematically illustrating a process of opening the first guide member 42 and the second guide member 43 in the jam processing structure 40. FIG. 11 is a section view schematically illustrating a process of closing a cover in a part of the jam processing structure 40.

At first, when the detecting device 17 detects the jam, the control device 13 controls the driving source and others to stop the conveyance of the sheet S and the image forming process. The control device 13 displays a procedure of an unjamming process (jam clearing process) on the operation part 100 (liquid crystal screen).

Next, the user executes the unjamming process (jam clearing process) in accordance to the procedure displayed on the operation part 100. Specifically, the user operates the unlock lever 41*b* to unlock the cover 41 and to turn the cover 41 to the outside (clockwise in a front view) (see a solid line arrow in FIGS. 3 and 5). Thereby, the cover 41 turns centering of each cover rotating shaft 41*a* and is displaced from the closing position P11 to the opening position P12 (see FIG. 2).

In succession, as shown in FIG. 10, the user holds the handle part 42*b* appearing within the opening 2*a* of the apparatus body 2 to turn the first guide member 42 to the outside. Then, the first guide member 42 turns clockwise centering on the first rotating shaft 42*a* in a front view. Due to that, a conveyance nip N3 of the conveying roller pair 15 is released. When the turn of the first guide member 42 advances, the pressing part 42*c* of the first guide member 42 abuts against the abutment surface 43*b* of the second guide member 43. When the turn of the first guide member 42 advances further, the pressing part 42*c* pushes up the second guide member 43. Then, the second guide member 43 starts to turn counterclockwise centering on each second rotating shaft 43*a* in a front view.

In response to the turn of the second guide member 43, the slide boss 43*c* of the second guide member 43 pushes up the lever 56 (see a solid line arrow in FIG. 11) while relatively moving in a left direction along the guide groove 65*b*. The lever 56 turns clockwise in a front view centering on each lever rotating shaft 65*a*. When the turn of the second guide member 43 and the lever 56 advances, the elastic member 57 exerts a moment on the lever 56 such that the lever 56 heads toward the open holding position P42 (see FIG. 9). Thereby, as shown in FIG. 4, the second guide member 43 is displaced from the second closed position P31 to the second opening position P32. In the same time, the lever 56 is displaced from the closure holding position P41 to the open holding position P42. It is noted that the user displaces the first guide member 42 from the first closure holding position P41 to the open holding position P42. The first guide member 42 displaced to the first opening position P22 is exposed to the outside through the opening 2*a* of the apparatus body 2.

Thereby, the conveying path 6 and the reverse path 7 are opened (see FIG. 4). Then, the user removes the sheet S jammed in the conveying path 6 or the reverse path 7. This arrangement makes it possible to simply and quickly unjam around the fixing device 12 where a probability of causing a jam is high.

According to the multi-function printer 1 of the present embodiment described above, the first guide member 42 contacts with the second guide member 43 in the process of moving from the first closed position P21 to the first opening position P22 and moves the second guide member 43 toward the second opening position P32 from the second closed position P31. Thus, the second guide member 43 is opened in synchronism with the opening operation of the first guide member 42. That is, it is possible to also open the reverse path 7 just by opening the conveying path 6. Accordingly, in executing the unjamming process, the user is just required to move the first guide member 42 from the first closed position P21 to the first opening position P22. This arrangement makes it possible to provide the user-friendly multi-function printer 1 because the procedure of the unjamming process can be simplified.

Next, when the unjamming process ends, the user returns the respective guide members 42 and 43 and the cover 41 to their original positions. It is noted that a procedure after the unjamming process is also displayed on the operation part 100 (liquid crystal screen). At first, the user turns the first guide member 42 counterclockwise in a front view. Thereby, the first guide member 42 is displaced from the first opening position P22 to the first closed position P21.

In succession, as shown in FIG. 11, the user turns the cover 41 counterclockwise in a front view (see a broken line arrow in FIG. 11). When the turn of the cover 41 advances, the pressing piece 41*c* of the cover 41 enters the lever storage part 63 from the slit part 63*b* of the rear wall part 62. Then, the pressing piece 41*c* abuts against the abutment part 66 (the inclined surface 66*a*) of the lever 56. When the turn of the cover 41 advances further, the pressing piece 41*c* presses the abutment part 66 in the left direction. Then, the lever 56 turns counterclockwise centering on each lever rotating shaft 65*a* in a front view (see a broken line arrow in FIG. 11).

Along with the turn of the lever 56, the slide boss 43*c* of the second guide member 43 moves in the right direction along the guide groove 65*b* (see FIG. 5). In the same time, the second guide member 43 turns clockwise in a front view centering on the respective second rotating shafts 43*a* (see FIG. 5). When the turn of the second guide member 43 and the lever 56 advances, the elastic member 57 exerts a moment on the lever 56 such that the lever 56 heads toward the closure holding position P41 (see FIG. 9). Thereby, the second guide member 43 is displaced from the second opening position P32 to the second closed position P31 as shown in FIG. 3. In the same time, the lever 56 is displaced from the open holding position P42 to the closure holding position P41. The cover 41 is displaced from the opening position P12 to the closing position P11.

Thereby, the conveying path 6 and the reverse path 7 are constructed again (see FIG. 3). The control device 13 recognizes that no jam is detected by the respective detecting devices 16 and 17 and enables to execute the image forming process again.

According to the multi-function printer 1 of the present embodiment described above, the cover 41 contacts with the second guide member 43 displaced from the opening position P32 in the process of moving from the opening position P12 to the closing position P11 and moves the second guide member 43 from the second opening position P32 to the second closed position P31. Thus, the second guide member 43 is closed in synchronism with the sealing operation of the cover 41. When the unjamming process ends, the user turns the cover 41 from the opening position P12 to the closing position P11 after displacing the first guide member 42 to the first closed position P21. Then, the second guide member 43 is displaced to the second closed position P31 and composes the reverse path 7. This arrangement makes it possible to improve usability because the procedure (restoring procedure) for constructing the respective conveying paths 6 and 7 again after the unjamming process is simplified. It is also possible to prevent such trouble as an occurrence of a jam from otherwise being caused when the second guide member 43 is not closed after the unjamming process by interlocking the closing operation of the second guide member 43 with the sealing operation of the cover 41.

Still further, according to the multi-function printer 1 of the present embodiment, the second guide member 43 is held at the second closed position P31 or the second opening position P32 through the lever 56 receiving the bias force of the elastic member 57. It is possible to adequately construct the reverse path 7 again by holding the second guide member 43 at the second closed position P31. Meanwhile, it is possible to facilitate the unjamming process by holding the second guide member 43 at the second opening position P32.

It is noted that while the first guide member 42 forms the part of the conveying path 6 and the second guide member 43 forms the part of the reverse path 7 in the multi-function printer 1 of the present embodiment described above, the present disclosure is not limited to such configuration. For instance, the first guide member 42 may form the entire conveying path 6. That is, the first guide member 42 may form at least a part of the conveying path 6. The same applies to the second guide member 43.

It is noted that while the jam processing structure 40 of the multi-function printer 1 of the present embodiment is provided to execute the unjamming process around the fixing device 12, the present disclosure is not limited to such configuration. For instance, the jam processing structure 40 may be provided to execute an unjamming process around the registration roller pair 14 (the detecting device 16).

Still further, the case in which the present disclosure is applied to the multi-function printer 1 as one example has been described in the present embodiment, the present disclosure is not limited to such case, and the present disclosure is applicable also to a color printer, a monochrome printer, a facsimile, and the like.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a conveying path conveying a sheet from a supply part to a discharge part through an image forming part;

a reverse path branched from the conveying path on a downstream side in a sheet conveying direction of the image forming part and conveying the sheet again to the image forming part;

a first guide member provided movably between a first closed position for forming the conveying path and a first opening position for opening the conveying path;

a second guide member provided movably between a second closed position for forming the reverse path by facing the first guide member and a second opening position for opening the reverse path; and a move supporting mechanism for guiding a movement of the second guide member;

wherein the first guide member contacts with the second guide member in a process of moving from the first closed position to the first opening position and moves the second guide member from the second closed position to the second opening position;

the move supporting mechanism comprising;

a frame for turnable supporting the second guide member;

a lever for linking the frame with the second guide member; and an elastic member mounted between the lever and the frame;

wherein the lever is supported by the frame turnably between a closure holding position where the second guide member is held at the second closed position by being biased by the elastic member and an open holding position where the second guide member is held at the second opening position by being biased by the elastic member.

2. The image forming apparatus according to claim 1, further comprising:

an apparatus body supporting the first and second guide members; and a cover provided turnably between a closed position for closing an opening formed on the apparatus body and an opening position for opening the opening, wherein the cover contacts with the second guide member displaced to the second opening position in a process of moving from the opening position to the closed position and moving the second guide member from the second opening position to the second closed position.

3. The image forming apparatus according to claim 1, wherein a slide boss is projectively provided on the second guide member, a guide groove slidably for supporting the slide boss is concavely provided on the lever, and the slide boss turns the lever while relatively moving along the guide groove along with the turn of the second guide member.

4. The image forming apparatus according to claim 1, wherein the lever is rotated around a lever rotating shaft at one end part thereof;

the elastic member is mounted between the frame and another end part of the lever, the elastic member is located below the lever rotating shaft in a state in which the lever is displaced to the closure holding position and biases the second guide member toward the second closed position through the lever, and the elastic member is located above the lever rotating shaft in a state in which the lever is displaced in the open holding position and biases the second guide member toward the second opening position through the lever.

5. The image forming apparatus according to claim 1, further comprising:

a fixing device fixing a toner image transferred on the sheet to the sheet in the image forming part, wherein the first guide member is configured to be the conveying path on a downstream side in the sheet conveying direction of the fixing device.

6. The image forming apparatus according to claim 1, further comprising:

a fixed guide member for facing the first guide member displaced to the first closed position; and a conveying roller pair provided along the conveying path;

wherein the first guide member rotatably supports one roller of the conveying roller pair; and the fixed guide member rotatably supports another roller of the conveying roller pair.

* * * * *